US008969270B2

(12) United States Patent
Kawasaki

(10) Patent No.: US 8,969,270 B2
(45) Date of Patent: Mar. 3, 2015

(54) WATER-SOLUBLE METAL WORKING FLUID, AND COOLANT FOR METAL WORKING

(75) Inventor: Hiroshi Kawasaki, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 255 days.

(21) Appl. No.: 13/060,171

(22) PCT Filed: Aug. 14, 2009

(86) PCT No.: PCT/JP2009/064331
§ 371 (c)(1),
(2), (4) Date: Feb. 22, 2011

(87) PCT Pub. No.: WO2010/021299
PCT Pub. Date: Feb. 25, 2010

(65) Prior Publication Data

US 2011/0147645 A1 Jun. 23, 2011

(30) Foreign Application Priority Data

Aug. 22, 2008 (JP) ..... 2008-214435
Oct. 16, 2008 (JP) ..... 2008-267832

(51) Int. Cl.
*C10M 173/02* (2006.01)
*C10M 141/06* (2006.01)
*C10M 173/00* (2006.01)

(52) U.S. Cl.
CPC ..... *C10M 173/02* (2013.01); *C10M 2207/125* (2013.01); *C10M 2209/107* (2013.01); *C10M 2209/108* (2013.01); *C10M 2215/042* (2013.01); *C10N 2230/06* (2013.01); *C10N 2230/12* (2013.01); *C10N 2230/18* (2013.01); *C10N 2240/401* (2013.01); *C10N 2240/402* (2013.01)
USPC ..... 508/530; 508/527; 508/131; 252/71; 252/72; 252/77; 252/79

(58) Field of Classification Search
USPC ..... 252/71, 72, 77, 79; 508/527, 530, 131
See application file for complete search history.

(56) References Cited

U.S. PATENT DOCUMENTS

| | | | | | |
|---|---|---|---|---|---|
| 2,967,831 | A * | 1/1961 | Hommer | 252/77 |
| 3,925,030 | A * | 12/1975 | Garth | 44/404 |
| 4,719,084 | A * | 1/1988 | Schmid et al. | 422/16 |
| 4,828,735 | A * | 5/1989 | Minagawa et al. | 508/507 |
| 6,855,676 | B2 * | 2/2005 | Li et al. | 508/532 |
| 7,851,420 | B2 * | 12/2010 | Theunissen et al. | 508/555 |
| 8,293,690 | B2 * | 10/2012 | Feustel et al. | 508/469 |
| 2003/0130142 | A1 * | 7/2003 | Nguyen | 508/494 |
| 2009/0149359 | A1 * | 6/2009 | Hundley et al. | 508/459 |

FOREIGN PATENT DOCUMENTS

| | | | | |
|---|---|---|---|---|
| CN | 1906279 | A | 1/2007 | |
| GB | 1165086 | A * | 9/1969 | C10M 173/02 |
| GB | 2 152 529 | A | 8/1985 | |
| JP | 40 14480 | | 7/1965 | |
| JP | 8 231977 | | 9/1996 | |
| JP | 10-324887 | | 12/1998 | |
| JP | 10 324888 | | 12/1998 | |
| JP | 2002 80882 | | 3/2002 | |
| JP | 2002 212584 | | 7/2002 | |
| JP | 3912837 | | 2/2007 | |
| WO | WO 85/00182 | A1 | 1/1985 | |
| WO | WO 2005/042676 | A2 | 5/2005 | |
| WO | WO 2009/016954 | A1 * | 2/2009 | C10M 141/08 |

OTHER PUBLICATIONS

Office Action issued on Jun. 18, 2013 in the corresponding Japanese Patent Application No. 2008-267832 (with English Translation).
Chinese Office Action issued Nov. 5, 2012, in China Patent Application No. 200980132793.X (with English translation).
International Search Report issued Nov. 10, 2009 in PCT/JP09/64331 filed Aug. 14, 2009.

(Continued)

*Primary Examiner* — Jane L Stanley
(74) *Attorney, Agent, or Firm* — Oblon, McClelland, Maier & Neustadt, L.L.P.

(57) ABSTRACT

A water-soluble metalworking fluid contains: at least either one of (A) a block polyalkylene glycol represented by formula (1): $HO(EO)_a$—$(PO)_b$-$(EO)_cH$, and (B) a polyalkylene glycol monoether represented by formula (2): $RO(R'O)_dH$; and (C) an alkanolamine fatty acid salt, in which EO represents —$CH_2CH_2O$ — and PO represents —$CH(CH_3)CH_2O$— or —$CH_2CH(CH_3)O$—; each unit of $(EO)_a$, $(PO)_b$ and $(EO)_c$ is block-bonded; a and c each is an integer of 1 to 30 and b is an integer of 5 to 100; R represents an alkyl group having 1 to 30 carbon atoms and R'O represents PO or EO; mole fraction of EO is less than 100%; and d is an integer of 1 or 50.

12 Claims, No Drawings

(56) References Cited

OTHER PUBLICATIONS

Brown, W.L.: "The Role of Polyalkylene Glycols in Synthetic Metalworking Fluids", Lubrication Engineering, vol. 44, No. 2, pp. 168-171, (Feb. 1988).

Combined Taiwanese Notice of Allowance and Search Report issued May 2, 2014 in Patent Application No. 098128302 (with English translation of part of bibliographic data and English translation of categories of cited documents).

* cited by examiner

WATER-SOLUBLE METAL WORKING FLUID, AND COOLANT FOR METAL WORKING

TECHNICAL FIELD

The present invention relates to water-soluble metalworking fluid and a metalworking coolant used for metalworking such as cutting or grinding, the metalworking coolant being prepared by diluting the water-soluble metalworking fluid with water.

BACKGROUND ART

Metalworking fluid used in metalworking is generally categorized into oil-type (oil-based) fluid and water-type (water-based) fluid, the latter of which is more frequently used because such water-based fluid is excellent in cooling capabilities and infiltration capabilities and free from a risk of causing a fire. Known water-based fluid includes: emulsion-type fluid prepared by mixing a surfactant with oil-based base oil such as a mineral oil; soluble-type fluid which contains an increased content of surfactant; and solution-type fluid, the main component of which is a water-soluble lubricating agent such as a polyalkylene glycol. Water-soluble solution-type fluid not containing a mineral oil is frequently used when cooling capabilities is significant, e.g., in grinding. Known solution-type fluid is a water-based lubricating composition prepared by mixing an alkanolamine fatty acid salt with a polyoxyalkylene glycol (see Patent Literature 1).

However, since a long-lasting grinding stone using superabrasives (diamond, CBN) has been recently widespread, more lubricity is being demanded for solution-type fluid. Accordingly, water-soluble metalworking fluid containing mono-carboxylic acid or di-carboxylic acid having carbon atoms of 6 to 10 and a block polyalkylene glycol of (PO)-(EO)—(PO) type is proposed (see Patent Literature 2). According to this fluid, a solution-type fluid excellent in lubricity and antifoaming capabilities can be provided.

CITATION LISTS

Patent literatures

Patent Literature 1 JP-B-40-14480
Patent Literature 2 JP-A-8-231977

SUMMARY OF THE INVENTION

Problems to be Solved by the Invention

Though cooling capabilities of the water-based lubricating composition described in Patent Literatures 1 is excellent as solution-type fluid, lubricity thereof is inferior to oil-based, emulsion-type and soluble-type fluids. Solution-type fluid of Patent Literatures 2 is also not necessarily sufficient in lubricity even after being diluted by approximately 33 times. Particularly when the fluid is diluted with water by approximately 50 times, decrease in lubricity becomes more eminent. Further, water-soluble solution-type fluid may be impaired by rust resistance and antifoaming capabilities.

An object of the present invention is to provide water-soluble metalworking fluid that is diluted with water to provide a metalworking coolant that is excellent in lubricity, rust resistance and antifoaming capabilities.

Means for Solving the Problems

In order to solve the above problem(s), an aspect of the invention provides the following water-soluble metalworking fluid.

[1] A water-soluble metalworking fluid including: at least either one of (A) a block polyalkylene glycol represented by the following formula (1) and (B) a polyalkylene glycol monoether represented by the following formula (2); and (C) an alkanolamine fatty acid salt, $$HO(EO)_a—(PO)_b\text{-}(EO)_cH \quad (1)$$

in which EO represents —$CH_2CH_2O$— and PO represents —$CH(CH_3)CH_2O$— or —$CH_2CH(CH_3)O$—; each unit of $(EO)_a$, $(PO)_b$ and $(EO)_c$ is block-bonded; and a and c each is an integer of 1 to 30 and b is an integer of 5 to 100, $$RO(R'O)_dH \quad (2)$$

in which R represents an alkyl group having 1 to 30 carbon atoms and R'O represents PO or EO; mole fraction of EO is less than 100%; and d is an integer of 1 or 50.

[2] The water-soluble metalworking fluid in the above aspect of the invention, in which a mass average molecular weight of the component (A) is in a range of 500 to 10000.

[3] The water-soluble metalworking fluid in the above aspect of the invention, in which a, b and c in the component (A) satisfy a relation represented by the following formula (3):

$$(a+c)/(a+b+c)=0.1\sim0.5 \quad (3)$$

[4] The water-soluble metalworking fluid in the above aspect of the invention, in which a content of a combination of the components (A) and (B) is in a range of 5 to 40 mass % of a total amount of the fluid containing water, and a content of the component (C) is in a range of 30 to 75 mass % of the total amount of the fluid.

[5] A water-soluble metalworking coolant prepared by diluting the water-soluble metalworking fluid in the above aspect of the invention with water by 2 to 200 times in volume.

The water-soluble metalworking fluid according to the aspect of the invention, which contains polyalkylene glycols of a specific structure and alkanolamine fatty acid salts, can provide a coolant excellent in lubricity, rust resistance and antifoaming capabilities even when being highly diluted.

DESCRIPTION OF EXEMPLARY EMBODIMENTS

Exemplary embodiment(s) of the invention will be described below.

Water-soluble metalworking fluid according to an aspect of the present invention (hereinafter, also referred to as "the fluid") contains: at least either one of (A) a block polyalkylene glycol represented by the following formula (1) and (B) a polyalkylene glycol monoether represented by the following formula (2); and (C) an alkanolamine fatty acid salt.

$$HO(EO)_a—(PO)_b\text{-}(EO)_cH \quad (1)$$

$$RO(R'O)_dH \quad (2)$$

First of all, the component (A) will be described. The component (A) works as a water-soluble lubricating agent having low foaming capabilities.

In the above formula (1), EO represents —$CH_2CH_2O$— (ethylene oxide unit) and PO represents —$CH(CH_3)CH_2O$— or —$CH_2CH(CH_3)O$— (propylene oxide unit).

Each unit of $(EO)_a$, $(PO)_b$ and $(EO)_c$ described above is block-bonded. When EO and PO are bonded to each other at random, the fluid is unfavorably excessively foamed when being diluted.

In the formula (1), a and c each is an integer of 1 to 30, preferably 1 to 20 and b is an integer of 5 to 100, preferably 10 to 50. When a and c exceed 30, lubricity after being diluted with water is unfavorably decreased. When b is less than 5, lubricity after being diluted with water is unfavorably decreased. In contrast, when b exceeds 100, water solubility is unfavorably decreased.

When a mixture of a compound represented by the formula (1) is used as the component (A), a to c may be provisionally represented by decimals.

A mass average molecular weight of the component (A) is preferably 500 to 10000, more preferably 600 to 5000. When the mass average molecular weight is less than 500 or more than 10000, lubricity after being diluted with water may be decreased.

It is also preferable that a, b and c in the formula (1) satisfy the relation represented by the following formula (3):

$$(a+c)/(a+b+c)=0.1-0.5 \quad (3)$$

When a value of the formula (3) is less than 0.1, the component (A) is difficult to be dissolved in water, so that so-called stock solution stability is deteriorated. On the other hand, when the value of the formula (3) exceeds 0.5, lubricity after being diluted with water may be decreased.

Next, the component (B) will be described. The component (B) is a so-called polyalkylene glycol terminated at one end represented by the formula (2). The component (B) equally works as a water-soluble lubricating agent as the component (A).

R is a terminal group of a polyalkylene glycol and an alkyl group having 1 to 30 carbon atoms, more preferably 6 to 18 carbon atoms. When both ends of the polyalkylene glycol represented by the formula (2) are terminated, water solubility is unfavorably decreased. In contrast, when the both ends of the polyalkylene glycol represented by the formula (2) are OH, lubricity after being diluted with water is unfavorably decreased.

When the number of carbon atoms of R exceeds 30, water solubility is unfavorably decreased.

R'O is PO and/or EO and PO and EO are preferably block-bonded, which contributes to low foaming capabilities. Mole fraction of EO is less than 100%. When the mole fraction of EO is 100%, antifoaming capabilities are unfavorably poor.

In the formula (2), d is an integer of 1 to 50, preferably 3 to 30. When d exceeds 50, lubricity after being diluted with water may be decreased. When a mixture of a compound represented by the formula (2) is used as the component (B), d may be provisionally represented by decimals.

Next, the component (C) will be described. The component (C) is an alkanolamine fatty acid salt and mainly works as a rust inhibitor in the fluid. The alkanolamine fatty acid salt is preferably added to the fluid as a salt that is previously prepared from an alkanolamine and a fatty acid, rather than the alkanolamine and the fatty acid being separately added to the fluid. Particularly when a dibasic acid is used as the fatty acid, the dibasic acid, which is solid, is preferably mixed with other components after a salt is prepared. An equivalent ratio of amine to fatty acid (amines/fatty acids) is favorably not so high. When the equivalent ratio of amine to fatty acid is too high, a friction coefficient of the fluid being diluted with water may be rather increased. Specifically, the equivalent ratio thereof is preferably 2 or less, more preferably 1.5 or less. Moreover, the equivalent ratio thereof is preferably 1 or more in order to dissolve fatty acids.

Alkanolamines to form the alkanolamine fatty acid salt of the component (C) are not limitative, but primary or tertiary amines are preferable in view of rot resistance.

For example, primary or tertiary amines represented by the following formulae (4) and (5) are favorable.

[Chemical Formula 1]

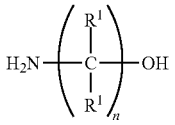

(4)

[Chemical Formula 2]

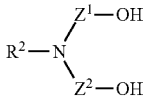

(5)

In the above formula (4), $R^1$ represents hydrogen or an alkyl group having 1 to 3 carbon atoms. n represents 2 or 3. $R^1$ each may be the same or different, but it is preferable that not all of $R^1$ represent hydrogen. When n is 4 or more, water solubility is unfavorably reduced. n is the most preferably 2. When n is 1 and all of $R^1$ are hydrogen, formaldehyde may be unfavorably easily discharged due to degradation. In addition, when any one of $R^1$ has 4 or more carbon atoms, the water solubility thereof and rust resistance thereof for iron are unfavorably deteriorated.

Examples of alkanolamines represented by the above formula (4) include: 1-amino-2-propanol, 2-amino-2-methyl-1-propanol, 1-amino-2-butanol, 2-amino-1-propanol, 3-amino-2-butanol and the like. Among the above, in view of the rust resistance for iron, 1-amino-2-propanol and 2-amino-2-methyl-1-propanol are particularly preferable. In the fluid, single one of the above substances may be used, or two or more thereof may be used.

Alkanolamines represented by the above formula (5) contributes not only to rust resistance but also to rot resistance. In the formula, $R^2$ represents an alkyl group having 1 to 10 carbon atoms. In case of $R^2$ being hydrogen, rot resistance is unfavorably deteriorated. When $R^2$ has a non-cyclic structure, $R^2$ preferably contains 1 to 4 carbon atoms, more preferably 1 carbon atom. When $R^2$ contains 11 or more carbon atoms, water solubility and rust resistance are unfavorably deteriorated. $Z^1$ and $Z^2$ each independently represent an alkylene group having 2 to 8 carbon atoms. When the number of the carbon atoms contained in at least either one of $Z^1$ and $Z^2$ is 1, formaldehyde is generated by degradation, which is unfavorable. When the number of the carbon atoms contained in at least either one of $Z^1$ and $Z^2$ is 9 or more, water solubility of the component (B) are unfavorably deteriorated.

Examples of alkanolamines represented by the above formula (5) include: N-methyldiethanolamine, N-ethyldiethanolamine, N-cyclohexyldiethanolamine, N-n-propyldiethanolamine, N-i-propyldiethanolamine, N-n-butyldiethanolamine, N-i-butyldiethanolamine, N-t-butyldiethanolamine and the like. $R^2$ preferably includes a branched alkyl structure or a cycloalkyl structure because rot resistance can be enhanced. $R^2$ is particularly preferably N-cyclohexyldiethanolamine. In the fluid, single one of the above substances may be used, or two or more thereof may be used.

The fatty acid to form a salt with each of the above alkanolamines is exemplified by mono- and di-carboxylic acid having 6 to 60 carbon atoms. Specific examples of the fatty acid include: caproic acid, caprylic acid, nonane acid, lauric acid, stearic acid, olein acid, ricinolein acid, hydroxyfatty acid (such as recinoleic acid and 12-hydroxystearic acid), arachidic acid, behenic acid, melissic acid, isononane acid, neo-decane acid, isostearic acid, fatty acid extracted from fat and oil such as soy oil fatty acid, coconut oil fatty acid and rape-seed oil fatty acid, acid extracted from petroleum such as naphthene acid, adipic acid, sebacic acid, dodecanoic diacid, monohydroxy arachidic acid and dihydroxy arachidic acid, and synthetic fatty acid such as dimer or trimer of olein acid, recinoleic acid, ricinolein acid, 12-hydroxystearic acid.

In view of antifoaming capabilities and stability of hard water in the fluid, examples of particularly preferable carboxylic acid include caproic acid having 8 to 10 carbon atoms, nonane acid having 8 to 10 carbon atoms, isononane acid having 8 to 10 carbon atoms, and decane acid having 8 to 10 carbon atoms while examples of particularly preferable dicarboxylic acid include nonane diacid having 9 to 12 carbon atoms, undecanoic diacid having 9 to 12 carbon atoms, sebacic acid having 9 to 12 carbon atoms, dodecanoic diacid having 9 to 12 carbon atoms and the like.

Particularly, above-mentioned isononane acid is excellent in reducing solid substances being formed on a surface of the fluid (stability of hard water) when the fluid (stock solution) is diluted with water.

In view of rot resistance, the alkyl group that is a main chain of the fatty acid preferably has a branched structure. For the fatty acid, although dibasic acids are excellent in rust resistance as a salt, dibasic acids and monobasic acids are preferably mixed in use in view of stability (unlikeliness to be insoluble) of the stock solution described below.

The pH of the alkanolamine fatty acid salt of the component (C) is preferably 8 to 11 in view of rust resistance. The component (C) is dissolved in ion-exchange water to a 2.0 volume % concentration and pH is measured by a pH meter (PHL-20 manufactured by DKK Corporation) at room temperature.

The water-soluble metalworking fluid according to the aspect of the invention may be formed of the component (A) and the component (C). Alternatively, the water-soluble metalworking fluid may be formed of the component (B) and the component (C). The fluid particularly preferably contains all the three components: a combination of the components (A) and (B); and the component (C), because lubricity and antifoaming capabilities can be further enhanced when the fluid is diluted with water.

In the fluid (stock solution), a content of the combination of the components (A) and (B) (either one of them may be used) is preferably 5 to 40 mass % of a total amount of the fluid containing water, and a content of the component (C) is preferably 30 to 75 mass % of the total amount of the fluid.

When the content of the combination of the components (A) and (B) is less than 5 mass %, decrease in lubricity (increase in a friction coefficient) may occur in case the fluid is to be highly diluted with water at a working site. On the other hand, when the content of the combination of the components (A) and (B) exceeds 40 mass %, stability of the stock solution is lowered. The stability of the stock solution means that uniformity of the stock solution is lost due to phase separation, undissolved mass or precipitation of solid content and the like.

When the content of the component (C) is less than 30 mass %, decrease in rust resistance may occur in case the fluid is diluted with too much water at a working site. On the other hand, when the content of the component (C) exceeds 75 mass %, the stability of the stock solution is lowered.

Water for preparing the stock solution is preferably 20 to 75 mass %. When water is less than 20 mass %, the components (A) to (C) are difficult to be dissolved and preparation of the stock solution becomes complicated. When water for preparing the stock solution exceeds 75 mass %, an excessive amount of stock solution has to be stored or transported, thereby lowering handleability.

The fluid (stock solution) is diluted with water by 2 to 200 times, preferably by 5 to 100 times in volume and is used as a metalworking coolant.

In the fluid, mass ratio ((A+B)/C) between the content of the combination of the components (A) and (B) (either one of them may be used) and the content of the component (C) is preferably from 0.05 to 1.5, more preferably from 0.1 to 1.2. When the mass ratio is less than 0.05, lubricity may be lowered (i.e., a friction coefficient may be increased). When the mass ratio exceeds 1.5, rust resistance may be lowered.

The water-soluble metalworking fluid may be blended as necessary with publicly-known various kinds of additives as long as such addition is compatible with an object of the present invention. The additives are exemplified by an extreme pressure agent, an oiliness agent, antifoaming agent and the like.

Examples of the extreme pressure agent include: a sulfur-based extreme pressure agent, a phosphorus-based extreme pressure agent, an extreme pressure agent containing sulfur and metal and an extreme pressure agent containing phosphorus and metal. These extreme pressure agents may be used alone or in a combination of two or more. The extreme pressure agent may be any extreme pressure agent, as long as the extreme pressure agent contains a sulfur atom and/or a phosphorus atom in its molecule and as long as the extreme pressure agent can provide load bearing effects and wear resistance. Examples of the extreme pressure agent containing sulfur in its molecule include: sulfurized fat and oil, sulfurized fatty acid, ester sulfide, olefin sulfide, dihydrocarbyl polysulfide, a thiadiazole compound, an alkylthiocarbamoyl compound, a triazine compound, a thioterpene compound, a dialkylthiodipropionate compound and the like. In view of blending effects, the extreme pressure agent is preferably blended in the stock solution to approximately 0.05 to 0.5 mass % of the total amount of the final diluted fluid.

Examples of the oiliness agent include: a fatty acid compound such as aliphatic alcohol, fatty acid and fatty acid metal salt, an ester compound such as polyol ester, sorbitan ester and glyceride, an amine compound such as aliphatic amine and the like. In view of blending effects, the oiliness agent is preferably blended in the stock solution to approximately 0.2 to 2 mass % of the total amount of the final diluted fluid.

Examples of the antifoaming agent include methyl silicone oil, fluorosilicone oil, polyacrylates and the like. In view of blending effects, the antifoaming agent is preferably blended in the stock solution to approximately 0.004 to 0.04 mass % of the total amount of the final diluted fluid.

The water-soluble metalworking fluid according to the above aspect of the invention, which is diluted as necessary with water so that its concentration is adjusted suitably for the usage, is preferably applied in various metalworking fields such as cutting, grinding, polishing, squeezing, drawing, flatting and the like. The water-soluble metalworking fluid according to the above aspect of the invention is excellent in lubricity as well as rust resistance and antifoaming capabilities for metal products irrespective of dilute concentration.

EXAMPLES

Next, the invention will be described in detail with reference to Examples, but is not limited at all by the Examples.

Examples 1 to 18, Comparatives 1 to 9

A water-soluble metalworking fluid (stock solution) was prepared according to compounding ratios shown in Tables 1 to 3. Details of respective components are as follows. For the component (C) of the aspect of the invention, alkanolamines and fatty acids, which form alkanolamine fatty acid salts, were previously mixed at a predetermined equivalent ratio and then blended. Tables 1 to 3 show a content of each component.

Component (A)

A block polyalkylene glycol below was used.

(1)$HO(EO)_5$—$(PO)_{30}$-$(EO)_5H$ (2)$HO(EO)_{1.5}$—$(PO)_{21}$-$(EO)_{1.5}H$ (3)$HO(EO)_{13}$—$(PO)_{30}$-$(EO)_{13}H$

Component (B)

(1) $C_{12}H_{25}O(R'O)nH$ (NOIGEN NL-Dash 408 manufactured by DAI-ICHI KOGYO SEIYAKU CO., LTD)

(2) $C_{12}H_{25}O(PO)m(EO)nH$ (EMULGEN LS-106 manufactured by Kao Corporation)

(3) $C_4H_8O(R'O)nH$ (EO=50 mol %, NEWPOL 50HB-260 manufactured by Sanyo Chemical Industries, Ltd)

(4) $C_{10}H_{21}O(R'O)nH$ (NOIGEN XL-70 manufactured by DAI-ICHI KOGYO SEIYAKU CO., LTD)

(5) $C_{13}H_{27}O(R'O)nH$ (NOIGEN TDX-80D manufactured by DAI-ICHI KOGYO SEIYAKU CO., LTD)

(6) $C_{16}H_{33}O(PO)_4(EO)_{10}H$ (7) $C_{16}H_{33}O(PO)_8(EO)_{20}H$

Component (C)

(1) 1-amino-2-propanol (2) N-methyldiethanolamine (3) N-cyclohexyldiethanolamine (4) triethanolamine (5) isononane acid (6) crude dodecanedioic acid (Corfree M1 manufactured by INVISTA JAPAN K.K.: dodecanedioic acid 42%)

Other Components (1) $C_{10}H_{21}O(EO)nH$ (NOIGEN SD-70 manufactured by DAI-ICHI KOGYO SEIYAKU CO., LTD)

(2) $RO(EO)_7H$(R:C12-14)

(3) glycerin R'O adduct (EO=67 mol %)

(4) trimethylolpropane$(EO)_3$ adduct (5) 1-butoxy-2-propanol (6) others (a package of antifoaming agent and the like)

(7) distilled water for preparing the stock solution

The following properties each were evaluated based on the stock solution having the above compounding ratios. Evaluation results are shown in Tables 1 to 3.

(1) Lubricity (Friction Coefficient)

The stock solution was diluted with tap water by 2 volume % and then a dynamic friction coefficient was obtained by a reciprocating dynamic friction coefficient test below.

Method of Reciprocating Dynamic Friction Coefficient Test

Testing Machine: Reciprocating Dynamic Friction Coefficient Testing Machine (manufactured by A & D Company Ltd.)

Test Piece: Test Plate of SPCC SD; Test Ball of SUJ-2 (ϕ3/16inch (4.8 mm))

Test Conditions: solution temperature at room temperature, amplitude of 40 mm, speed of 40 mm/s, load of 0.5 kgf (4.9N)

(2) Rust Resistance (Based on DIN51360-02-A)

Examinations of rust resistance were conducted at room temperature for two hours on fluid shown in Tables 1 to 3 prepared by diluting the stock solution with ion-exchange water by 2 volume %, and then generation of rust was visually checked.

(3) Antifoaming Capabilities

Antifoaming capabilities were evaluated by Cylinder method. Specifically, the stock solution of 2 ml was diluted by ion-exchange water of 98 ml by 2 volume %, and then the testing solution of 100 ml was put into a 100 ml stoppered measuring cylinder. After the testing solution being shaken hard for 5 seconds, time until the foam on the surface of the testing solution occupied 50% or less of the surface area thereof was measured. Standards of the evaluation are as follows.

A: Foam decreased to 50% or less of the surface area within 20 seconds.

B: Foam remained more than 50% of the surface area even after 20 seconds.

TABLE 1

| | | | | Example 1 | Example 2 | Example 3 | Example 4 | Example 5 | Example 6 | Example 7 | Example 8 | Example 9 |
|---|---|---|---|---|---|---|---|---|---|---|---|---|
| Compounding ratio of stock solution (mass %) | Component A | 1 | $HO(EO)_5$—$(PO)_{30}$—$(EO)_5H$ | 10.0 | 15.0 | — | — | — | — | — | — | — |
| | | 2 | $HO(EO)_{1.5}$—$(PO)_{21}$—$(EO)_{1.5}H$ | — | — | — | — | — | — | — | — | — |
| | | 3 | $HO(EO)_{13}$—$(PO)_{30}$—$(EO)_{13}H$ | — | 5.0 | — | — | — | — | — | — | — |
| | Component B | 1 | $C_{12}H_{25}O(R'O)nH$ | 10.0 | — | — | — | — | — | — | — | — |
| | | 2 | $C_{12}H_{25}O(PO)m(EO)nH$ | — | — | 10.0 | 20.0 | — | — | — | — | — |
| | | 3 | $C_4H_8(R'O)_nH$, EO = 50% | — | — | — | — | 20.0 | — | — | — | — |
| | | 4 | $C_{10}H_{21}O(R'O)nH$ | — | — | — | — | — | 20.0 | — | — | — |
| | | 5 | $C_{13}H_{27}O(R'O)nH$ | — | — | — | — | — | — | 20.0 | — | — |
| | | 6 | $C_{16}H_{33}O(PO)_4(EO)_{10}H$ | — | — | — | — | — | — | — | 20.0 | — |
| | | 7 | $C_{16}H_{33}O(PO)_8(EO)_{20}H$ | — | — | — | — | — | — | — | — | 20.0 |
| | Component C | 1 | 1-amino-2-propanol | 8.0 | 13.9 | 8.0 | 8.0 | 8.0 | 8.0 | 8.0 | 8.0 | 8.0 |
| | | 2 | N-methyldiethanolamine | — | — | — | — | — | — | — | — | — |
| | | 3 | N-cyclohexyldiethanolamine | 20.0 | 8.0 | 20.0 | 20.0 | 20.0 | 20.0 | 20.0 | 20.0 | 20.0 |
| | | 4 | triethanolamine | — | — | — | — | — | — | — | — | — |
| | | 5 | isononane acid | 0.8 | 0.8 | 0.8 | 0.8 | 0.8 | 0.8 | 0.8 | 0.8 | 0.8 |
| | | 6 | crude dodecanedioic acid | 14.3 | 15.4 | 14.3 | 14.3 | 14.3 | 14.3 | 14.3 | 14.3 | 14.3 |
| | | — | equivalent ratio of amine to acid | (1.5) | (1.5) | (1.5) | (1.5) | (1.5) | (1.5) | (1.5) | (1.5) | (1.5) |
| | Other Components | 1 | $C_{10}H_{21}O(EO)nH$ | — | — | — | — | — | — | — | — | — |
| | | 2 | $RO(EO)_7H$ (R: C12-14) | — | — | — | — | — | — | — | — | — |
| | | 3 | glycerin R'O adduct (EO = 67%) | — | — | — | — | — | — | — | — | — |
| | | 4 | trimethylolpropane$(EO_3)$ adduct | — | — | — | — | — | — | — | — | — |

TABLE 1-continued

| | | | | Example 1 | Example 2 | Example 3 | Example 4 | Example 5 | Example 6 | Example 7 | Example 8 | Example 9 |
|---|---|---|---|---|---|---|---|---|---|---|---|---|
| | | 5 | 1-butoxy-2-propanol | — | — | — | — | — | — | — | — | — |
| | | 6 | others (antifoaming agent, etc.) | 1.9 | 1.9 | 1.9 | 1.9 | 1.9 | 1.9 | 1.9 | 1.9 | 1.9 |
| | | 7 | water | 35.0 | 40.0 | 45.0 | 35.0 | 35.0 | 35.0 | 35.0 | 35.0 | 35.0 |
| | TOTAL | | | 100.0 | 100.0 | 100.0 | 100.0 | 100.0 | 100.0 | 100.0 | 100.0 | 100.0 |
| Evaluation | | Friction Coefficient (2 volume %) | | 0.170 | 0.192 | 0.162 | 0.160 | 0.202 | 0.156 | 0.172 | 0.186 | 0.162 |
| | | Rust Resistance (2 volume %) | | no rust | no rust | no rust | no rust | no rust | no rust | no rust | no rust | no rust |
| | | Antifoaming Capabilities (2 volume %) | | A | A | A | A | A | A | A | A | A |

TABLE 2

| | | | | Example 10 | Example 11 | Example 12 | Example 13 | Example 14 | Example 15 | Example 16 | Example 17 | Example 18 |
|---|---|---|---|---|---|---|---|---|---|---|---|---|
| Compounding ratio of stock solution (mass %) | Component A | 1 | HO $(EO)_5$—$(PO)_{30}$—$(EO)_5$H | 15.0 | — | — | — | 15.0 | 15.0 | 15.0 | 15.0 | 15.0 |
| | | 2 | HO $(EO)_{1.5}$—$(PO)_{21}$—$(EO)_{1.5}$H | 5.0 | 5.0 | 5.0 | 5.0 | 5.0 | — | — | — | — |
| | | 3 | HO $(EO)_{13}$—$(PO)_{30}$—$(EO)_{13}$H | — | 15.0 | 15.0 | 35.0 | — | 5.0 | 5.0 | 5.0 | 5.0 |
| | Component B | 1 | $C_{12}H_{25}O(R'O)nH$ | — | — | — | — | — | — | — | — | — |
| | | 2 | $C_{12}H_{25}O(PO)m(EO)nH$ | — | — | — | — | — | — | — | — | — |
| | | 3 | $C_4H_8(R'O)_nH$, EO = 50% | — | — | — | — | — | — | — | — | — |
| | | 4 | $C_{10}H_{21}O(R'O)nH$ | — | — | — | — | — | — | — | — | — |
| | | 5 | $C_{13}H_{27}O(R'O)nH$ | — | — | — | — | — | — | — | — | — |
| | | 6 | $C_{16}H_{33}O(PO)_4(EO)_{10}H$ | — | — | — | — | — | — | — | — | — |
| | | 7 | $C_{16}H_{33}O(PO)_8(EO)_{20}H$ | — | — | — | — | — | — | — | — | — |
| | Component C | 1 | 1-amino-2-propanol | 19.5 | 19.5 | — | — | 13.9 | 15.4 | 8.9 | 9.9 | — |
| | | 2 | N-methyldiethanolamine | — | — | 21.5 | 18.7 | — | — | — | — | — |
| | | 3 | N-cyclohexyldiethanolamine | 8.0 | 8.0 | 8.0 | 7.0 | 8.0 | 13.0 | 22.3 | — | — |
| | | 4 | triethanolamine | — | — | — | — | — | — | — | 19.2 | 25.6 |
| | | 5 | isononane acid | 0.8 | 0.8 | 0.8 | 0.7 | 0.8 | 0.8 | 0.8 | 0.8 | 0.8 |
| | | 6 | crude dodecanedioic acid | 9.8 | 9.8 | 7.9 | 6.9 | 15.4 | 18.9 | 16.1 | 18.2 | 11.7 |
| | | — | equivalent ratio of amine to acid | (3.0) | (3.0) | (2.5) | (2.5) | (1.5) | (1.5) | (1.5) | (1.5) | (1.5) |
| | Other Components | 1 | $C_{10}H_{21}O(EO)nH$ | — | — | — | — | — | — | — | — | — |
| | | 2 | $RO(EO)_7H$ (R: C12-14) | — | — | — | — | — | — | — | — | — |
| | | 3 | glycerin R'O adduct (EO = 67%) | — | — | — | — | — | — | — | — | — |
| | | 4 | trimethylolpropane($EO_3$) adduct | — | — | — | — | — | — | — | — | — |
| | | 5 | 1-butoxy-2-propanol | — | — | — | — | — | — | — | — | — |
| | | 6 | others (antifoaming agent, etc.) | 1.9 | 1.9 | 1.8 | 1.7 | 1.9 | 1.9 | 1.9 | 1.9 | 1.9 |
| | | 7 | water | 40.0 | 40.0 | 40.0 | 25.0 | 40.0 | 30.0 | 30.0 | 30.0 | 40.0 |
| | TOTAL | | | 100.0 | 100.0 | 100.0 | 100.0 | 100.0 | 100.0 | 100.0 | 100.0 | 100.0 |
| Evaluation | | Friction Coefficient (2 volume %) | | 0.190 | 0.208 | 0.202 | 0.210 | 0.204 | 0.200 | 0.188 | 0.184 | 0.176 |
| | | Rust Resistance (2 volume %) | | no rust | no rust | no rust | no rust | no rust | no rust | no rust | no rust | no rust |
| | | Antifoaming Capabilities (2 volume %) | | A | A | A | A | A | A | A | A | A |

TABLE 3

| | | | | Comparative 1 | Comparative 2 | Comparative 3 | Comparative 4 | Comparative 5 | Comparative 6 | Comparative $7_{(1)}$ | Comparative $8_{(2)}$ | Comparative $9_{(3)}$ |
|---|---|---|---|---|---|---|---|---|---|---|---|---|
| Compounding ratio of stock solution (mass %) | Component A | 1 | HO $(EO)_5$—$(PO)_{30}$—$(EO)_5$H | — | — | — | — | — | — | — | — | — |
| | | 2 | HO $(EO)_{1.5}$—$(PO)_{21}$—$(EO)_{1.5}$H | — | — | — | — | — | — | — | — | — |
| | | 3 | HO $(EO)_{13}$—$(PO)_{30}$—$(EO)_{13}$H | — | — | — | — | — | — | — | — | — |
| | Component B | 1 | $C_{12}H_{25}O(R'O)nH$ | — | — | — | — | — | — | — | — | — |
| | | 2 | $C_{12}H_{25}O(PO)m(EO)nH$ | — | — | — | — | — | — | — | — | — |
| | | 3 | $C_4H_8(R'O)_nH$, EO = 50% | — | — | — | — | — | — | — | — | — |
| | | 4 | $C_{10}H_{21}O(R'O)nH$ | — | — | — | — | — | — | — | — | — |
| | | 5 | $C_{13}H_{27}O(R'O)nH$ | — | — | — | — | — | — | — | — | — |
| | | 6 | $C_{16}H_{33}O(PO)_4(EO)_{10}H$ | — | — | — | — | — | — | — | — | — |
| | | 7 | $C_{16}H_{33}O(PO)_8(EO)_{20}H$ | — | — | — | — | — | — | — | — | — |
| | Component C | 1 | 1-amino-2-propanol | 19.5 | 19.5 | 19.5 | 8.0 | 8.0 | 24.6 | 19.5 | 19.5 | 19.5 |
| | | 2 | N-methyldiethanolamine | — | — | — | — | — | — | — | — | — |
| | | 3 | N-cyclohexyldiethanolamine | 8.0 | 8.0 | 8.0 | 20.0 | 20.0 | 10.0 | 8.0 | 8.0 | 8.0 |
| | | 4 | triethanolamine | — | — | — | — | — | — | — | — | — |
| | | 5 | isononane acid | 0.8 | 0.8 | 0.8 | 0.8 | 0.8 | 1.0 | 0.8 | 0.8 | 0.8 |
| | | 6 | crude dodecanedioic acid | 9.8 | 9.8 | 9.8 | 14.3 | 14.3 | 12.3 | 9.8 | 9.8 | 9.8 |
| | | — | equivalent ratio of amine to acid | (3.0) | (3.0) | (3.0) | (1.5) | (1.5) | (3.0) | (3.0) | (3.0) | (3.0) |

TABLE 3-continued

| | | | | Comparative 1 | Comparative 2 | Comparative 3 | Comparative 4 | Comparative 5 | Comparative 6 | Comparative 7(1) | Comparative 8(2) | Comparative 9(3) |
|---|---|---|---|---|---|---|---|---|---|---|---|---|
| | Other Components | 1 | $C_{10}H_{21}O(EO)nH$ | — | — | — | 20.0 | — | — | — | — | — |
| | | 2 | $RO(EO)_7H$ (R: C12-14) | — | — | — | — | 20.0 | — | — | — | — |
| | | 3 | glycerin R'O adduct (EO = 67%) | 20.0 | — | — | — | — | — | — | — | — |
| | | 4 | trimethylolpropane($EO_3$) adduct | — | 20.0 | — | — | — | — | — | — | — |
| | | 5 | 1-butoxy-2-propanol | — | — | 20.0 | — | — | — | — | — | — |
| | | 6 | others (antifoaming agent, etc.) | 1.9 | 1.9 | 1.9 | 1.9 | 1.9 | 2.1 | 1.9 | 1.9 | 1.9 |
| | | 7 | water | 40.0 | 40.0 | 40.0 | 35.0 | 35.0 | 50.0 | 40.0 | 40.0 | 40.0 |
| | TOTAL | | | 100.0 | 100.0 | 100.0 | 100.0 | 100.0 | 100.0 | 100.0 | 100.0 | 100.0 |
| Evaluation | | | Friction Coefficient (2 volume %) | 0.310 | 0.258 | 0.278 | 0.158 | 0.160 | 0.252 | 0.274 | 0.268 | 0.286 |
| | | | Rust Resistance (2 volume %) | no rust | no rust | no rust | no rust | no rust | no rust | no rust | no rust | no rust |
| | | | Antifoaming Capabilities (2 volume %) | A | A | A | B | B | A | A | A | A |

1) 5.0 mass % of $HO(EO)_{80}$—$(PO)_{30}$-$(EO)_{80}H$ was mixed in place of the component (A) and 15.0 mass % of $C_{10}H_{21}O(R'O)_{100}H$ (NOIGEN XL-1000F manufactured by DAI-ICHI KOGYO SEIYAKU CO., LTD) was mixed in place of the component (B).
2) 20.0 mass % of $C_{10}H_{21}O(R'O)_{100}H$ (NOIGEN XL-1000F manufactured by DAI-ICHI KOGYO SEIYAKU CO., LTD) was mixed in place of the component (B).
3) 5.0 mass % of $HO(EO)_{80}$—$(PO)_{30}$-$(EO)_{80}H$ and 15.0 mass % of $HO(EO)_{93}$—$(PO)_{35.3}$-$(EO)_{93}H$ were mixed in place of the component (A).

Evaluation Results

As is understood from Tables 1 and 2, the water-soluble metalworking fluid according to each of Examples 1 to 18 of the aspect of the invention is excellent in lubricity, rust resistance, rot resistance and antifoaming capabilities. Particularly, lubricity is sufficiently maintained even when the stock solution is highly diluted with water (2 volume %).

In contrast, according to the result of Table 3, since the water-soluble metalworking fluid according to each of Comparatives 1 to 3 and 6 to 9 does not contain the essential components required in the aspect of the invention, dynamic friction coefficient is extremely high when the stock solution is highly diluted with water. In other words, lubricity of the above fluids after being highly diluted is poor. As is understood from Comparatives 7 to 9, lubricity of the above fluids after being highly diluted is insufficient even when the above fluids are mixed with a polyalkylene glycol that has a different structure from the components (A) and (B) according to the aspect of the invention. Moreover, in Comparatives 4 and 5 using a polyalkylene glycol having EO of 100% mole fraction in place of the component (B), antifoaming capabilities are poor.

In Examples and Comparatives, alkanolamine fatty acid salts were prepared by mixing alkanolamines with fatty acids in the fluid. As is understood from the result, alkanolamine fatty acid salts at the equivalent ratio between amine and fatty acid being as high as 3.0 are likely to have rather lowered lubricity.

The invention claimed is:

1. A water-soluble metalworking fluid, comprising:

at least either one of a block polyalkylene glycol and a polyalkylene glycol monoether; and an alkanolamine fatty acid salt, wherein the block polyalkylene glycol is of formula (1)

$$HO(EO)_a—(PO)_b-(EO)_cH \quad (1),$$

wherein EO is $—CH_2CH_2O—$,

PO is $—CH(CH_3)CH_2O—$ or $—CH_2CH(CH_3)O—$, each unit of $(EO)_a$, $(PO)_b$ and $(EO)_c$ is block-bonded, a and c are each independently an integer of from 1 to 30, b is an integer of from 5 to 100, a, b, and c satisfy formula (3)

$$(a+c)/(a+b+c)=0.1\text{-}0.5 \quad (3), \text{ and}$$

the polyalkylene glycol monoether is of formula (2)

$$RO(R'O)_dH \quad (2),$$

wherein R is an alkyl group having 1 to 30 carbon atoms,

R'O is PO or EO, a mole fraction of EO is less than 100%, and d is an integer of from 1 to 50, the alkanolamine fatty acid salt comprises an alkanolamine comprising a tertiary amine of formula (5)

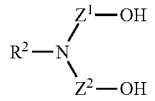

(5)

wherein $R^2$ is an alkyl group having 1 to 10 carbon atoms, and $Z^1$ and $Z^2$ are each independently an alkylene group having 2 to 8 carbon atoms, and the water-soluble metalworking fluid is soluble in water.

2. The water-soluble metalworking fluid according to claim 1, wherein the mass average molecular weight of the block polyalkylene glycol is from 500 to 10,000.

3. The water-soluble metalworking fluid according to claim 2, wherein the fluid further comprises water, and the content of a combination of the block polyalkylene glycol and the polyalkylene glycol monoether is from 5 to 40 mass % of a total amount of the fluid comprising water, and the content of the alkanolamine fatty acid salt is from 30 to 75 mass % of the total amount of the fluid comprising water.

4. The water-soluble metalworking fluid according to claim 1, wherein the fluid further comprises water, and the content of a combination of the block polyalkylene glycol and the polyalkylene glycol monoether is from 5 to 40 mass % of a total amount of the fluid comprising water, and the content of the alkanolamine fatty acid salt is from 30 to 75 mass % of the total amount of the fluid comprising water.

5. A water-soluble metalworking coolant prepared by diluting the water-soluble metalworking fluid according to claim 4 with water by an amount of 2 to 200 times in volume.

6. The water-soluble metalworking fluid according to claim 1, wherein PO is —$CH(CH_3)CH_2O$—.

7. The water-soluble metalworking fluid according to claim 1, wherein PO is —$CH_2CH(CH_3)O$—.

8. The water-soluble metalworking fluid according to claim 1, wherein a and c are each independently an integer of from 1 to 20.

9. The water-soluble metalworking fluid according to claim 1, wherein b is an integer of from 10 to 50.

10. The water-soluble metalworking fluid according to claim 1, wherein the mass average molecular weight of the block polyalkylene glycol is from 600 to 5000.

11. The water-soluble metalworking fluid according to claim 1, wherein R is an alkyl group having 6 to 18 carbon atoms.

12. The water-soluble metalworking fluid according to claim 1, wherein d is an integer of from 3 to 30.

* * * * *